US005341970A

United States Patent [19]

Woods

[11] Patent Number: 5,341,970

[45] Date of Patent: Aug. 30, 1994

[54] ACOUSTIC CEILING PATCH SPRAY

[76] Inventor: John R. Woods, 22647 Ventura Blvd., Suite 307, Woodland Hills, Calif. 91365

[21] Appl. No.: 19,419

[22] Filed: Feb. 19, 1993

[51] Int. Cl.[5] ..... B65D 83/00

[52] U.S. Cl. ..... 222/394; 239/346; 401/190; 521/78; 106/122

[58] Field of Search ..... 521/78; 239/346; 401/190; 222/394; 106/122

[56] References Cited

U.S. PATENT DOCUMENTS

| | | | |
|---|---|---|---|
| 3,096,001 | 7/1963 | Boe et al. | 521/78 |
| 3,338,848 | 8/1967 | Hamilton | 521/78 |
| 3,512,330 | 3/1971 | Gander | 521/78 |
| 3,640,916 | 2/1972 | Dill | 521/78 |
| 3,705,669 | 12/1972 | Cox | 521/78 |
| 3,776,702 | 12/1973 | Chant | 521/78 |
| 3,912,665 | 10/1975 | Spitzer et al. | 521/78 |
| 3,912,666 | 10/1975 | Spitzer et al. | 521/78 |
| 4,584,324 | 4/1986 | Bauman et al. | 521/78 |
| 5,037,011 | 8/1991 | Woods | 322/394 |
| 5,180,753 | 1/1993 | Osipow et al. | 521/79 |

*Primary Examiner*—Morton foelak
*Attorney, Agent, or Firm*—Roger A. Marrs

[57] ABSTRACT

A pressurized dispenser is disclosed herein having a container housing a quantity of acoustic ceiling patch or textured material mixed with base, filler and a binder as well as with a carrier such as aerosol. A manual pump or spray nozzle is included on the container for selective discharge of the patch or textured material onto a prepared area which is a drywall or support sheet so as to match and blend in with the surrounding acoustic ceiling surface area to provide continuous and unbroken coextensive surface texture of mechanically and visually matched material.

1 Claim, 1 Drawing Sheet

ACOUSTIC CEILING PATCH SPRAY

BACKGROUND OF THE INVENTION

1. Field of the Invention

The present invention relates to surface texture material dispensing devices, and more particularly to a novel pressurized substance in semi-liquid form adapted to be sprayed onto a drywall or supporting surface so that after subsequent curing and hardening, a matching textured surface is provided with that of surrounding acoustic ceiling areas.

2. Brief Description of the Prior Art

It has been the conventional practice in the procedure of repairing drywall or patching acoustic ceiling areas to remove the damaged portion of the ceiling and subsequently filling any holes, depressions or the like with a textured patch material. The patch or replacement material is applied by means of a trowel or other flat tool which will press the patch material into the hole or depression and which will prepare and provide a surface area to receive a finish surface coating. After the patch material has cured and adhered to the original support material, a smooth surface is provided which receives the final coating. This coating leaves a smooth surface which is not matched to the surrounding roughened or textured surface.

An acoustic ceiling surface usually presents a surface texture which is bumpy or presents an orange peel look and sometimes is referred to as a "Popcorn effect". Such an appearance and surface texture cannot be attained through the use of smoothing tools or patch tools once the patch material has been applied to the damaged or repaired area. Therefore, difficulties and problems have been encountered which stem largely from the fact that the use and application of conventional patching material on acoustic ceiling repairs leaves a surface texture which does not match the surrounding area and which is noticeable after the complete repair has been completed.

Therefore, a long-standing need has existed to provide a novel material that may be readily applied to a repaired patch or surface so that the surface will match with the surrounding surface texture of an acoustic ceiling. Furthermore, the surface texture material to be applied to a repaired or patched area should be contained in a hand-held applicator so that the material may be conveniently stored as well as applied to the repaired area in a simple and convenient manner.

SUMMARY OF THE INVENTION

Accordingly, the above problems and difficulties are obviated by the present invention which provides a novel dispenser including a pressurized container holding a quantity of acoustic ceiling surface texture material in a fluid or semi-fluid condition so that upon depression of a dispensing nozzle, the material will be discharged and directed to a patch area intended to receive the surface texture. The surface texture material includes a filler, a base and a binder and an aerosol agent serving as a carrier medium so that the texture material may be applied by spray and will adhere to the repaired patch and drywall surface.

In one form of the invention, the acoustic ceiling textured material may be of a base or emulsion of water and/or solvent. The adhesive binder may be an acrylic or a natural or synthetic polymer and the carrier for pressurizing the dispensing of the material may be an aerosol with a filler being an aggregate and/or an expansive material.

Therefore, it is among the primary objects of the present invention to provide an inexpensive and economical means for matching surface texture of a repaired or patched surface area on an acoustic ceiling support panel with the surrounding acoustic surface area of the drywall.

Another object of the present invention is to improve the appearance of acoustic ceiling patched or repaired areas on a ceiling surface by employing a spray-on textured material which covers the repaired or patched area and visually assumes the surface texture of the surrounding acoustic ceiling surface.

Still another object of the present invention is to provide a hand-held dispensing unit containing a pressurized acoustic ceiling surface textured material for spray-on and direct application of the material in a liquid or semi-liquid form onto a repaired or patched area so that the surrounding surface texture will be visually and mechanically matched.

Yet a further object of the present invention is to provide a pressurized textured material in a dispenser that may be sprayed onto a patched area in drywall so as to match the surface texture normally applied with a compressor onto an acoustic ceiling surface.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
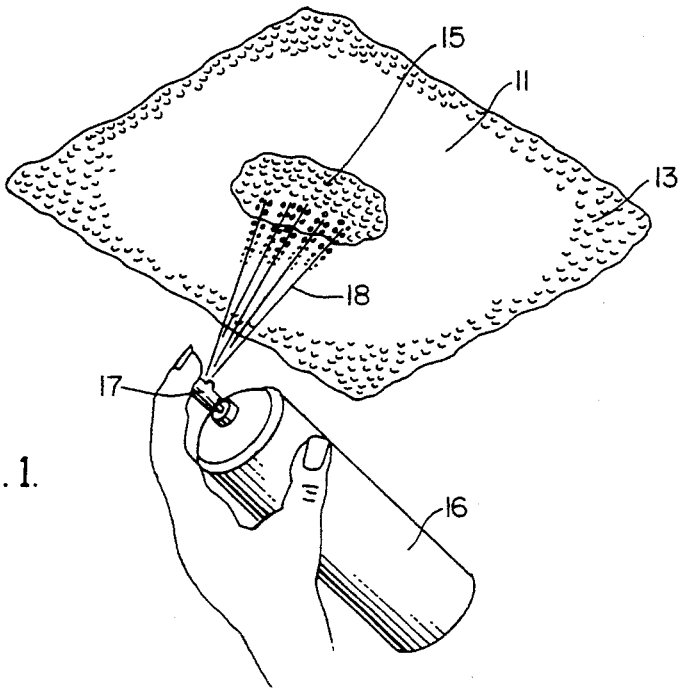
FIG. 1 is a diagrammatic view illustrating the direct application of the spray-on surface texture material of the present invention for repairing of an acoustic ceiling.
Figure 2:
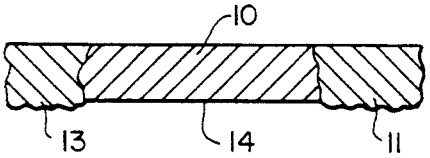
FIG. 2 is a transverse cross-sectional view of the repaired or patched area shown in FIG. 1 illustrating the dissimilarity in surface texture between the original drywall surface and the surface of the patched area.

Referring in detail to FIGS. 1 and 2, a fragmentary view is shown of a typical ceiling support panel or board and is identified by numeral 10. The panel supports textured acoustic material 11 which has been damaged and a repair to the damaged area is required which takes the form of a patch 15. After curing, the patch becomes solidified and adheres to the edge marginal region of the panel and material 11 defining the area covered by the patch material. The surface texture of the material is identified by numeral 13 and it can be seen that the surface texture is broadly defined as being bumpy, pebbled or presently an orange peel or popcorn look.

In FIG. 2, it can be seen that the patch displays a smooth surface 14 usually attained by repeatedly drawing the edge of a hand tool across the surface. After drying or curing, the material of the patch becomes hard and the surface 14 remains smooth and unmatched with the surrounding irregular or raised surface 13 carried on the panel. Although the surface 14 will accept a variety of coating such as paint or the like in a conventional situation, the surface texture of the coating does not simulate or blend with the surrounding irregular surface 13. Visually, the flat patch area is always noticeable and indicates the presence of a repair.

Figure 3:
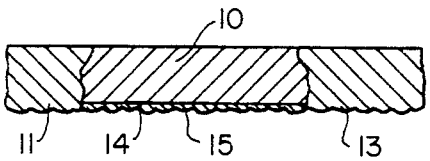
FIG. 3 is a transverse cross-sectional view of the repaired or patched area on an acoustic ceiling and illustrating matching of surface texture between the surface of the patch and the surrounding ceiling surface after use of the novel spray-on surface textured material of the present invention.

Referring now in detail to FIG. 3, the novel material and dispenser of the present invention is illustrated as being applied to the smooth surface 14 of the patch 10. In this connection, a bumpy and irregular surface is placed on the flat surface 14 so as to be compatible with, blend with and be coextensive with the surrounding drywall surface area. By employment of the present invention, the surface texture of both the patch and the surrounding acoustic ceiling material are substantially identical and matched so that no visual indication is presented or noticeable pertaining to a repair or patch. The material being applied is broadly indicated by numeral 15 which is contained within a container 16 and applied in the form of a spray in either liquid or semi-liquid condition. Application is achieved by depression of a pump or spray nozzle 17 which permits discharge of the pressurized material carried within the container 16. Such an application of the material is directly placed on the desired area 14 by the user who hand-carries the container 16 and operates the nozzle 17 on site. Wastage and loss of material is avoided since the discharge is under the control of the user through the application of the discharge nozzle 17. Therefore, there is no residue or excess material that is not used which requires disposal. Furthermore, the material 15 is lumpy and after curing on surface 14, provides an irregular surface compatible and matching the surrounding material surface area. Furthermore, the material in the container is considered a finished product and does not require additives of any kind and the labelling on the container may provide identification numbers and laboratory information.

Figure 4:
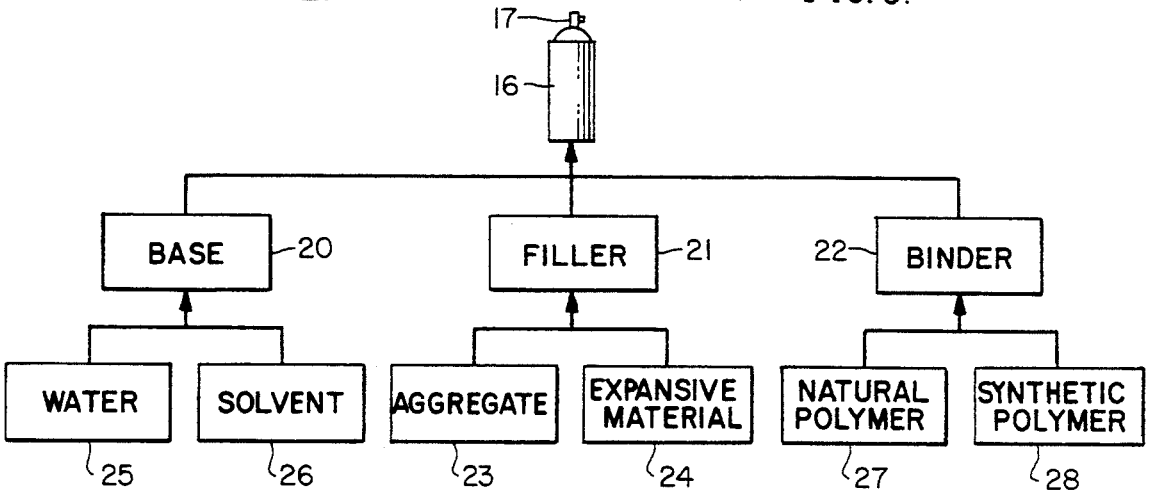
FIG. 4 is a diagram illustrating the components and substances employed in the spray-on texture material.

Preferably, as shown in FIG. 4, the material 15 comprises a mixture of a base material 20 such as water 25 and/or solvent 26 in liquid form and which contains a binder 22 as an adhesive 22 that may take the form of a natural 27 or synthetic polymer 28 such as alkyd or polyvinyl acetate. For pressurized discharge, an aerosol may be employed as a carrier with the base 20, binder 22 and a filler 21 liquid. The filler may be an aggregate 23, and/or an expansive material 24.

As illustrated, the coating 15 is applied directly to the smooth surface 14 and when dried or cured results in an irregular surface having a texture compatible and matched with the surrounding surface texture of the acoustic ceiling. The patch material is dried and cured in preparation for receiving the coating and the binder 22 included in the material 15 insures adhesion of the material to the patch area. Even if small amounts of the material would extend beyond the surface 14 onto the surrounding material, the surface would still be matched and no unsightly patch edges or dissimilar surface texture would be detectable. In one form, the expandable material may be a polyurethane and the aggregate may be styrofoam, cork, sponge or perlite.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a dispensing means for applying a hardenable flowable liquid to the surface of a patch surrounded by an acoustic ceiling material having an irregular surface texture comprising the combination of:

a hand-held, fluid-tight container having a quantity of hardenable substance intended to be dispensed;

means having a finger-operated discharge nozzle carried on said container for selectively releasing said hardenable substance in the form of a spray;

said hardenable substance comprising a mixture of a base substance, a filler substance, an adhesive binder, an aggregate and a pressurized carrier of compressed gaseous characteristics;

said hardenable fluid further characterized as having a bumpy, irregular surface texture after curing that is matched with and compatible with the surrounding acoustic ceiling material;

said base substance is chosen from the group selected from water, solvent or water combined with an alcohol solvent and said carrier is an aerosol;

said binder is chosen from a natural polymer;

said filler is chosen from clay, silica or limestone; and said aggregate is chosen from the group consisting of:

a. a closed cell polystyrene foam b. cork c. perlite.

* * * * *

UNITED STATES PATENT AND TRADEMARK OFFICE

CERTIFICATE OF CORRECTION

PATENT NO. : 5,341,970

DATED : August 30, 1994

INVENTOR(S) : John R. Woods

It is certified that error appears in the above-indentified patent and that said Letters Patent is hereby corrected as shown below:

Column 4, line 47, after "natural" insert -- or synthetic--.

Signed and Sealed this

First Day of August, 1995

*Attest:*

*Attesting Officer*

BRUCE LEHMAN

*Commissioner of Patents and Trademarks*